US007503559B2

(12) United States Patent
Yoshida

(10) Patent No.: US 7,503,559 B2
(45) **Date of Patent: *Mar. 17, 2009**

(54) SHEET FEEDING DEVICE AND IMAGE FORMING DEVICE WITH LINKED ROTATABLE GUIDE MEMBERS AND GUIDE PLATE

(75) Inventor: Kazuhiko Yoshida, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 178 days.

This patent is subject to a terminal disclaimer.

(21) Appl. No.: 11/293,234

(22) Filed: Dec. 5, 2005

(65) Prior Publication Data

US 2006/0285904 A1 Dec. 21, 2006

(30) Foreign Application Priority Data

Jun. 21, 2005 (JP) ..... 2005-180587

(51) Int. Cl.
*B65H 29/00* (2006.01)

(52) U.S. Cl. ..... 271/186; 271/4.1; 271/65; 271/301; 271/127; 271/10.11; 399/401; 399/364

(58) Field of Classification Search ..... 271/4.1, 271/4.01, 4.08, 65, 186, 301, 126, 127, 225, 271/10.01, 10.09, 10.11, 3.18, 3.19; 399/401, 399/364

See application file for complete search history.

(56) References Cited

U.S. PATENT DOCUMENTS 4,113,244 A * 9/1978 Ruenzi ..... 271/4.1
4,131,273 A * 12/1978 Kufrin et al. ..... 271/4.08
4,186,662 A * 2/1980 Borneman ..... 101/218
4,456,238 A * 6/1984 Mizuma ..... 271/3.02
4,660,963 A 4/1987 Stemmie
5,465,950 A * 11/1995 Takemoto et al. ..... 271/125
5,839,032 A * 11/1998 Yasui et al. ..... 399/124
6,128,463 A * 10/2000 Matsumoto et al. ..... 399/364
6,185,380 B1 * 2/2001 Abe et al. ..... 399/18
6,862,428 B2 * 3/2005 Sasaki ..... 399/401
2007/0007715 A1 1/2007 Yoshida

FOREIGN PATENT DOCUMENTS

JP 2004-85632 A 3/2004
JP 2004085632 A * 3/2004

* cited by examiner

*Primary Examiner*—Patrick H Mackey
*Assistant Examiner*—Gerald W McClain
(74) *Attorney, Agent, or Firm*—Sughrue Mion, PLLC

(57) ABSTRACT

A sheet supplying device, which supplies a sheet to an image forming section, has a sheet feeding roller, a sheet stacking section, and a guiding member. The sheet feeding roller sends sheets out one-by-one. The sheet stacking section can be stacked with plural sheets and pushes a sheet against the sheet feeding roller. The guiding member is able to move between a guiding position and a withdrawn position. At the guiding position, at a time of double-sided printing, the guiding member re-supplies to the image forming section an inverted sheet which is sent-in by a sheet re-supplying section. At the withdrawn position, the guiding member is moved toward the sheet feeding roller and feeding of the sheet of the sheet stacking section is possible.

20 Claims, 7 Drawing Sheets

SHEET FEEDING DEVICE AND IMAGE FORMING DEVICE WITH LINKED ROTATABLE GUIDE MEMBERS AND GUIDE PLATE

CROSS-REFERENCE TO RELATED APPLICATION

This application claims priority under 35 USC 119 from Japanese Patent Application No. 2005-180587, the disclosure of which is incorporated by reference herein.

BACKGROUND OF THE INVENTION

1. Field of the Invention

The present invention relates to a sheet supplying device at which a sheet conveying path can be switched when a sheet stacked in a sheet feed tray is sent-out, and when, at the time of double-sided printing, a sheet which is being conveyed along a sheet re-conveying path is again supplied to an image forming section, and relates to an image forming device equipped with the sheet supplying device.

2. Description of the Related Art

Conventionally, a sheet feeding roller, which sends-out one-by-one sheets which are stacked in a sheet feed tray, is disposed in an image forming device such as a copier, a printer or the like. The sheet which is fed-out by the sheet feeding roller is conveyed through a conveying path to an image forming section, and an image is formed on the surface of the sheet. Further, a sheet re-supplying path, which is for, at the time when double-sided printing is to be carried out on the sheet, inverting the sheet which has passed through the image forming section once and re-supplying the sheet to the image forming section, is disposed in the image forming device.

In such an image forming device, at the time of sheet feeding, the sheet which is stacked in the sheet feed tray is sent-out one-by-one and conveyed to the image forming section. At the time of double-sided printing, the sheet conveying path must be switched such that the sheet is re-conveyed by the sheet re-supplying path and is supplied again to the image forming section.

As a means therefor, for example, a re-feeding guiding member is provided between the sheets stacked in the sheet feed tray and the sheet feeding roller. The re-feeding guiding member is for again supplying, to the image forming section, the sheet which is conveyed-in from the sheet re-supplying path. At the time of double-sided printing, the re-feeding guiding member is disposed along the peripheral direction of the sheet feeding roller, and guides the sheet, which is conveyed along the sheet re-supplying path, to the image forming section. At the time of sheet feeding, the re-feeding guiding member is rotated by a motor to the upstream side, in the sheet feeding direction, of the sheet feeding roller, and is withdrawn from the sheet conveying path. In this way, when a sheet within the sheet feed tray is sent-out by the sheet feeding roller, the re-feeding guiding member does not interfere with the sheet. (Refer to, for example, Japanese Patent Application Laid-Open (JP-A) No. 2004-85632.)

However, in the sheet supplying device disclosed in JP-A 2004-85632, when a sheet is to be sent-out from the sheet feed tray, there is the need for space for rotating the re-feeding guiding member to the sheet feeding direction upstream side of the sheet feeding roller, and the need for a driving means such as a motor or the like for rotating the re-feeding guiding member. Therefore, the device becomes large, and costs increase.

SUMMARY OF THE INVENTION

The present invention was made in view of the aforementioned and provides a sheet supplying device and an image forming device in which the switching of a sheet conveying path, at the time of feeding of a sheet and at the time of double-sided printing of a sheet, can be carried out without a rise in costs and in a more compact space.

A first aspect of the present invention is a sheet supplying device supplying a sheet to an image forming section, the device comprising: a sheet feeding roller sending sheets out one-by-one; a sheet stacking section in which a plurality of sheets can be stacked, and which pushes a sheet against the sheet feeding roller; and a guiding member able to move between a guiding position at which, at a time of double-sided printing, the guiding member re-supplies to the image forming section an inverted sheet which is sent-in by a sheet re-supplying section, and a withdrawn position, at which the guiding member is moved toward the sheet feeding roller and at which feeding of the sheet of the sheet stacking section is possible.

In accordance with the invention of the first aspect of the present invention, the guiding member is provided so as to be movable between the guiding position and the withdrawn position. At the time of double-sided printing, the guiding member moves to the guiding position, and guides the sheet which is sent-in by the sheet re-supplying section, and re-supplies the sheet to the image forming section. Further, at the time of sheet feeding, due to the guiding member moving toward the sheet feeding roller, the guiding member moves to the withdrawn position at which the sheet feeding of the sheet stacking section is possible. Then, the sheets which are stacked in the sheet stacking section are pushed against the sheet feeding roller, and a sheet is fed-out one-by-one by the sheet feeding roller. Namely, the guiding member moves between the withdrawn position at the time of feeding a sheet and the guiding position at the time of re-supplying a sheet, and switches the conveying path of the sheet. Therefore, at the time of double-sided printing, the sheet does not interfere with the sheet feeding roller, and at the time of sheet feeding, the sheet does not interfere with the guiding member. Moreover, due to the guiding member moving to the withdrawn position which is toward the sheet feeding roller, the space over which the guiding member moves in order to switch the sheet conveying path is made to be small, and the device can be made more compact.

In the sheet supplying device and the image forming device relating to the present invention, the space over which the guiding member moves in order to switch the conveying path of the sheet at the time of double-sided printing and at the time of feeding a sheet from the sheet stacking section, can be made to be small, and compactness of the devices can be realized.

BRIEF DESCRIPTION OF THE DRAWINGS

Preferred embodiments of the present invention will be described in detail based on the following figures, wherein.

DETAILED DESCRIPTION OF THE INVENTION

Preferred embodiments of a sheet supplying device relating to the present invention will be described hereinafter on the basis of the drawings.

Figure 1:
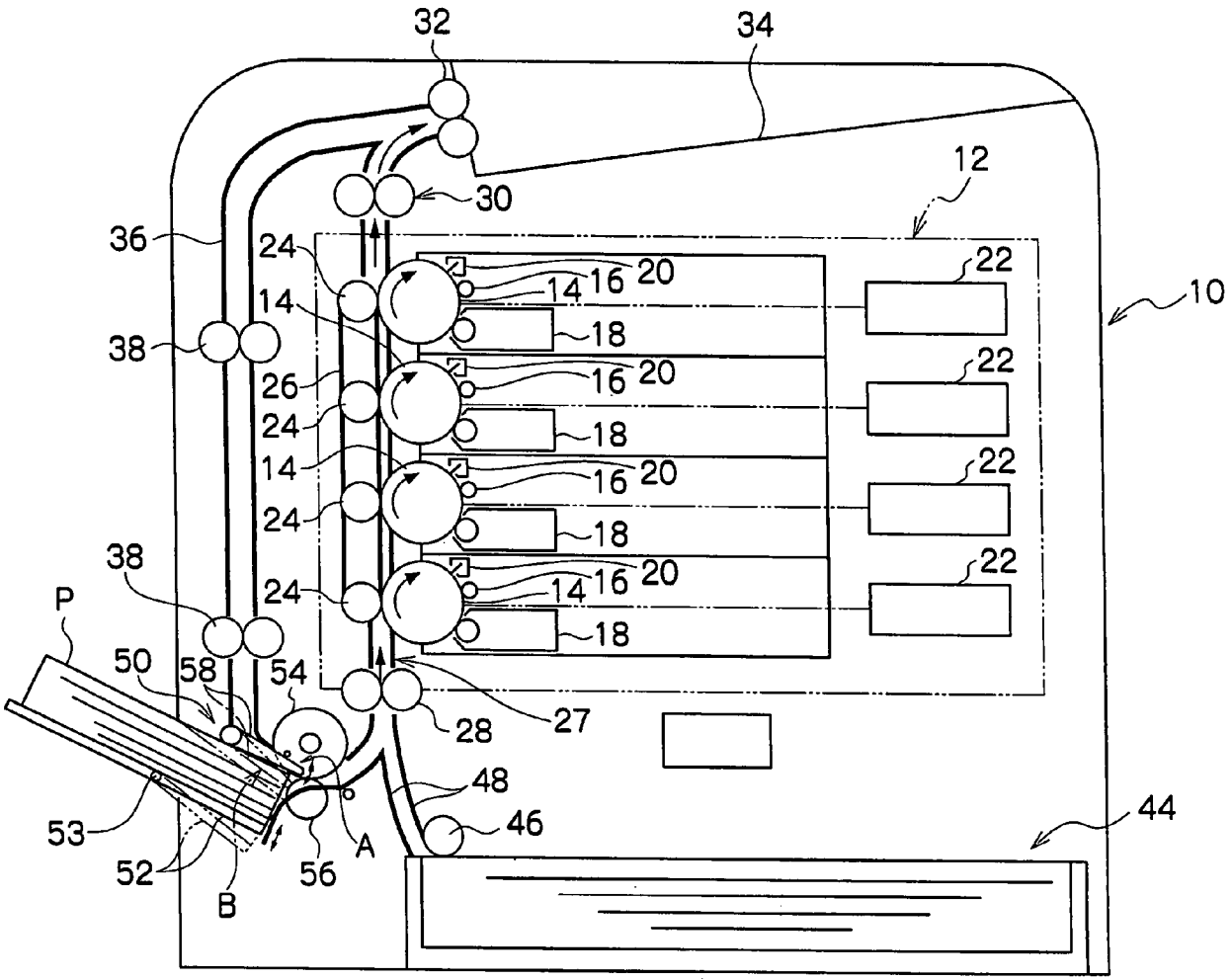
FIG. 1 is a schematic structural diagram showing an image forming device equipped with a sheet supplying device relating to a first embodiment of the present invention.

An image forming device 10 equipped with a sheet supplying device 50 of a first embodiment of the present invention is shown in FIG. 1.

The image forming device 10 has an image forming section 12 which forms toner images of the four colors of yellow, magenta, cyan, and black. In the image forming section 12, four photosensitive drums 14 are disposed at substantially uniform intervals in the vertical direction. A charger 16, a developing device 18, and a cleaner 20 are disposed along the circumferential direction at each of the photosensitive drums 14. An image writing device 22, which illuminates laser light onto the surface of the photosensitive drum 14, is provided between the charger 16 and the developing device 18.

Four transfer rollers 24 are provided so as to oppose the photosensitive drums 14, at the sides of the photosensitive drums 14 opposite the sides at which the image writing devices 22 are provided. A conveying belt 26 is trained about the periphery of the four transfer rollers 24, and a sheet P is conveyed along the conveying belt 26. The sheets P, which are paper sheets or the like, are fed one-by-one from the sheet supplying device 50 which will be described later, or from a sheet tray 44. The sheet P is conveyed by a pair of conveying rollers 28 disposed at a conveying path 27, and is conveyed between the respective photosensitive drums 14 and transfer rollers 24.

The surfaces of the photosensitive drums 14 are charged to predetermined potentials by the respective chargers 16. Then, the laser lights from the image writing devices 22 are illuminated such that the surfaces of the photosensitive drums 14 are exposed, and electrostatic latent images are formed thereon. The electrostatic latent images are developed by the developing devices 18 such that yellow, magenta, cyan, and black toner images are formed on the surfaces of the four photosensitive drums 14. The toner, which is not transferred onto the sheet P and remains on the surfaces of the photosensitive drums 14, is recovered by the cleaners 20.

The toner images which are formed on the surfaces of the photosensitive drums 14 are successively transferred, by the operation of the transfer rollers 24 which oppose the photosensitive drums 14, onto the sheet P which is being conveyed along the conveying belt 26, and the toner images of the four colors are superposed one on the other on the sheet P. Thereafter, the toner image on the sheet P is heated and fused at a fixing device 30 which is disposed at the conveying direction downstream side, such that the toner image is fixed on the sheet P. A pair of discharge rollers 32 are provided at the conveying direction downstream side of the fixing device 30. The sheet P is conveyed by the discharge rollers 32, and discharged-out onto a discharge tray 34.

On the other hand, when double-sided printing is to be carried out on the sheet P, after an image is formed on the obverse of the sheet P at the image forming section 12, the discharge rollers 32 are rotated reversely in a state in which the trailing end of the sheet P is nipped by the discharge rollers 32. In this way, the sheet P is inverted, and is conveyed to a re-supplying path 36 for double-sided printing. At the re-supplying path 36, the sheet P is conveyed by plural pairs of conveying rollers 38, and is supplied to the conveying rollers 28 of the conveying path 27 via the sheet supplying device 50 which will be described hereinafter. Then, the sheet P is again conveyed to the image forming section 12, and an image is formed on the reverse surface of the sheet P.

Figure 2A:
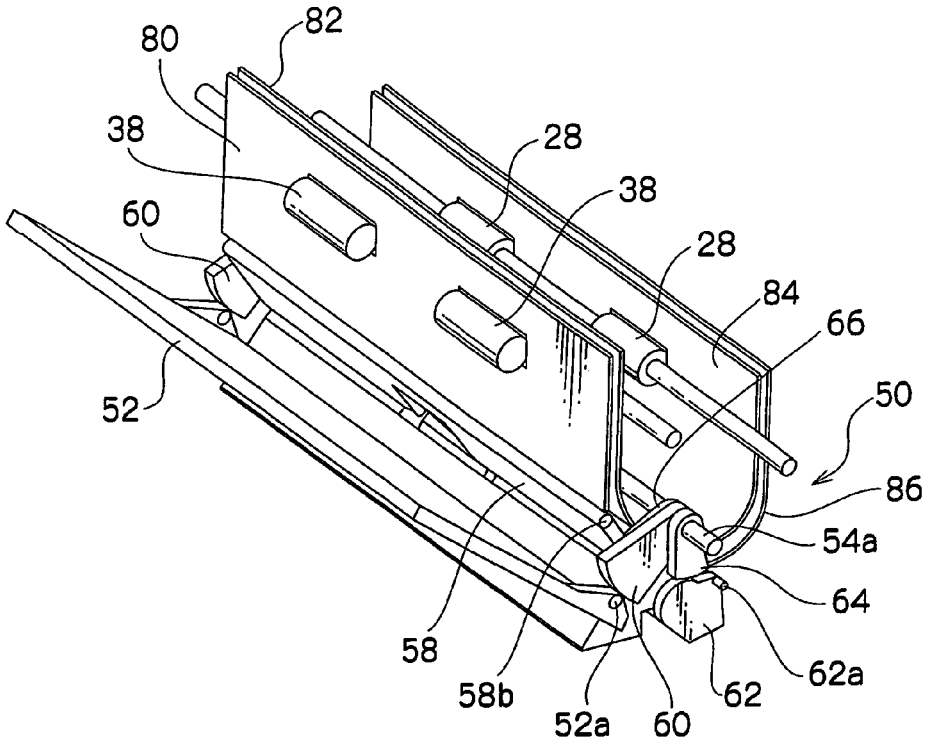
FIG. 2A is a perspective view of the sheet supplying device shown in FIG. 1 as seen from one direction.
Figure 2B:
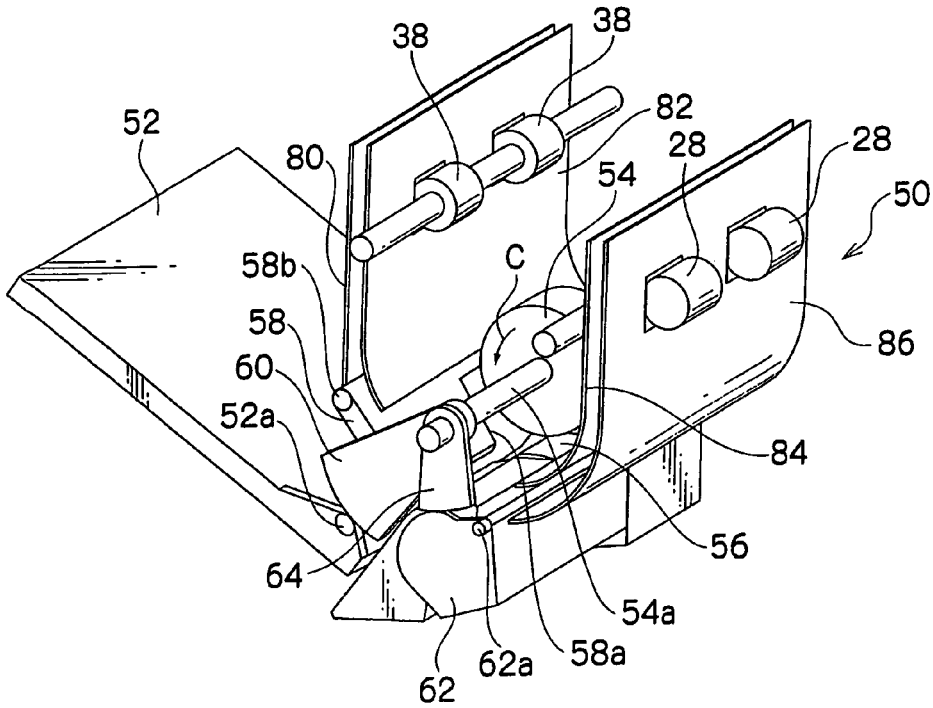
FIG. 2B is a perspective view of the sheet supplying device shown in FIG. 1 as seen from another direction.
Figure 4A:
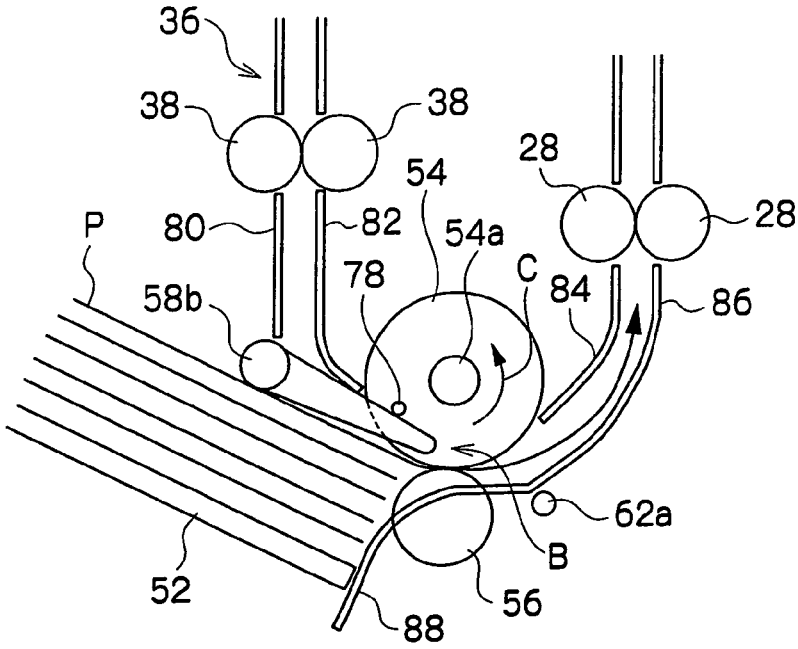
FIGS. 4A and 4B are structural diagrams showing a state in which the guiding member of the sheet supplying device shown in FIG. 1 is at a withdrawn position, and are diagrams showing states of first through third cams.
Figure 4B:
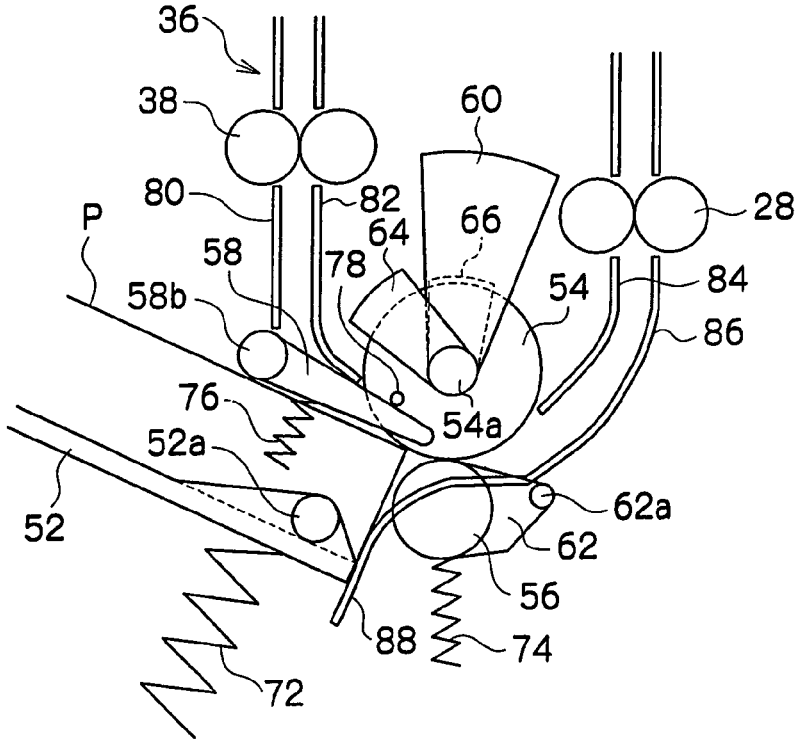

The sheet supplying device 50 is disposed at a side portion at the lower portion of the image forming device 10. As shown in FIGS. 2A, 2B and 4A, the sheet supplying device 50 has a sheet feed tray 52 in which plural sheets P can be stacked. A sheet feeding roller 54 is disposed diagonally above the sheet feeding direction downstream side of the sheet feed tray 52. The sheet feeding roller 54 can rotate in the direction of arrow C around a pivot 54*a* due to a motor (not shown). As shown in FIG. 4B, the sheets P which are stacked within the sheet feed tray 52 are pushed against the sheet feeding roller 54 due to a spring 72 which is provided beneath the sheet feed tray 52. Due to the sheet feeding roller 54 rotating while frictionally contacting the top surface of the sheet P, the uppermost sheet P is sent-out successively. A separating roller 56, which press-contacts the sheet feeding roller 54, is disposed beneath the sheet feeding roller 54. The sheets P are separated one-by-one at the nip portion between the sheet feeding roller 54 and the separating roller 56.

Figure 3:
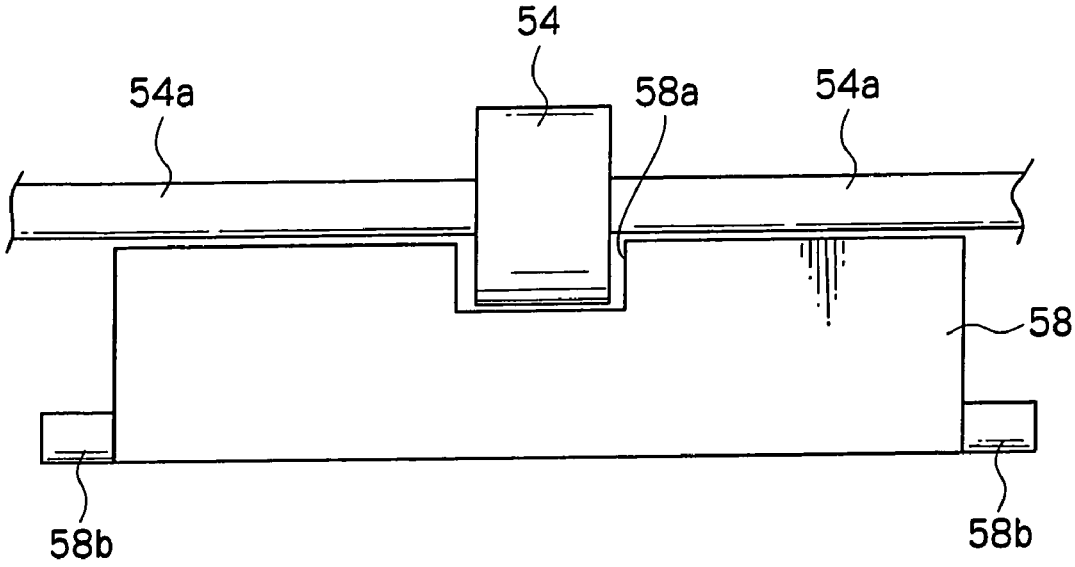
FIG. 3 is a view, as seen from a direction orthogonal to a longitudinal direction, of a sheet feeding roller and a guiding member of the sheet supplying device shown in FIG. 1.

A guiding member 58 is provided above the sheet feed tray 52, at the sheet feeding direction upstream side of the nip portion between the sheet feeding roller 54 and the separating roller 56. As shown in FIG. 3, an open cut-out portion 58*a* is formed at a portion of the guiding member 58 which portion opposes the outer shape of the sheet feeding roller 54. The distal ends of the both sides of the cut-out portion 58*a* are positioned at the both sides of the sheet feeding roller 54. The guiding member 58 is supported so as to be able to rotate around a pivot 58*b* which is at a sheet feeding direction upstream side. The guiding member 58 can rotate between a guiding position A (see FIGS. 5A and 5B), at which the guiding member 58 re-supplies to the image forming section 12 the sheet P which is sent-in from the re-supplying path 36 as shown in FIG. 1, and a withdrawn position B (see FIGS. 4A and 4B), at which the guiding member 58 is withdrawn toward the sheet feeding roller 54 and a sheet can be fed from the sheet feed tray 52. Because the cut-out portion 58*a* is formed in the guiding member 58, at the withdrawn position B, the guiding member 58 does not interfere with the sheet feeding roller 54, and does not impede rotation of the sheet feeding roller 54. Further, because the guiding member 58 rotates around the pivot 58*b* which is at the sheet feeding direction upstream side, the space over which the guiding member 58 moves can be made to be small.

Figure 5A:
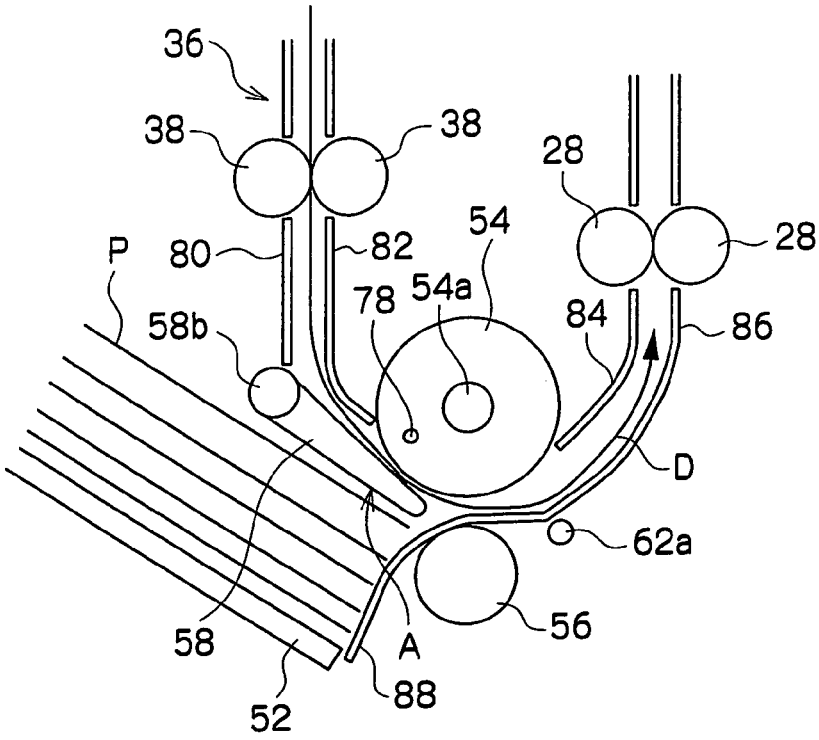
FIGS. 5A and 5B are structural diagrams showing a state in which the guiding member of the sheet supplying device shown in FIG. 1 is at a guiding position, and are diagrams showing states of the first through third cams.
Figure 5B:
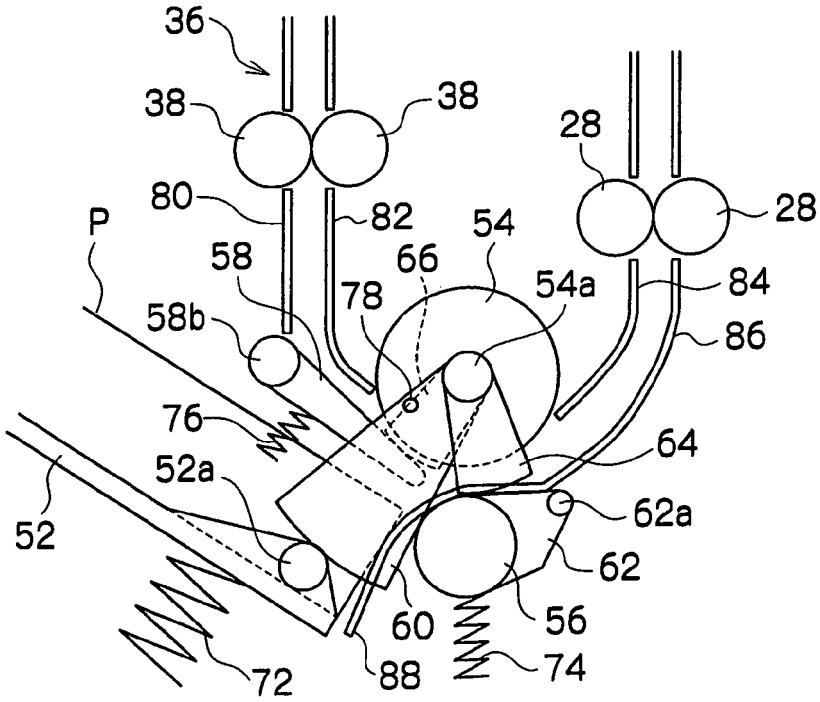

As shown in FIGS. 2A, 2B, and 5B, first cams 60, which can abut rollers 52*a* projecting-out at the both end portions of the sheet feed tray 52, are provided at the pivot 54*a* of the sheet feeding roller 54. Second cams 64, which can abut the both end portions of a frame 62 which rotatably supports the separating roller 56, are provided at the outer sides of the first cams 60 of the pivot 54*a*. Further, third cams 66, which can abut the both end portions of the surface of the guiding member 58, are provided at the inner sides of the first cams 60 of the pivot 54*a*. The first cams 60, the second cams 64, and the third cams 66 rotate integrally with the sheet feeding roller 54 due to rotation of the pivot 54*a*. By rotating the third cams 66, which move the guiding member 58, integrally with the sheet feeding roller 54, there is no need to provided a driving unit such as a motor or the like used for moving the guiding member 58, and costs can be reduced.

As shown in FIG. 1, the sheet feed tray 52 is structured so as to be able to rise and fall in the vertical direction around a pivot 53 which is at the sheet feeding direction upstream side. As shown in FIG. 4B, the spring 72 is provided beneath the sheet feed tray 52. The sheets P stacked in the sheet feed tray 52 are pushed toward the sheet feeding roller 54 by the urging force of the spring 72. The frame 62 is supported so as to be rotatable around a pivot 62*a* which is at the sheet feeding direction downstream side, and a spring 74 is provided beneath the frame 62. Due to the urging force of the spring 74, the frame 62 is urged in the direction of the sheet feeding roller 54 such that the separating roller 56 press-contacts the sheet feeding roller 54. Further, a spring 76 is provided beneath the guiding member 58. Due to the urging force of the spring 76, the guiding member 58 can be rotated to the withdrawn position B at which the guiding member 58 abuts a stopper 78.

Further, guide plates 80, 82 are disposed so as to oppose one another with the re-supplying path 36 therebetween, at the lower portion of the re-supplying path 36. The guide plates 80, 82 guide the sheet P, which is sent-in along the re-supplying path 36 at the time of double-sided printing, between the guiding member 58 and the sheet feeding roller 54. Further, guide plates 84, 86, which guide the sheet P to the conveying rollers 28, are disposed so as to oppose one another with the conveying path 27 of the sheet P therebetween, at the downstream side of the portion where the guiding member 58 and the sheet feeding roller 54 oppose one another. A guide plate 88, which restricts the leading end surfaces of the sheets P in the sheet feeding direction thereof, is disposed at the sheet feeding direction downstream side of the sheet feed tray 52.

As shown in FIG. 1, the sheet tray 44 is disposed at the lower portion of the image forming device 10. Sheets P of different sizes than the sheet feed tray 52 can be stacked within the sheet tray 44. A sheet feeding roller 46, which sends the stacked sheets P out one-by-one, is disposed at the sheet feeding direction downstream side of the sheet tray 44. Further, guide plates 48, which guide the sheet P to the conveying rollers 28, are disposed at the downstream side of the sheet feeding roller 46 so as to oppose one another with the conveying path of the sheet P therebetween.

Next, operation of the sheet supplying device 50 relating to the present invention will be described.

At the time of double-sided printing, as shown in FIG. 1, after the sheet P passes through the image forming section 12 and an image is formed on the obverse thereof, the discharging rollers 32 are rotated reversely in a state of nipping the trailing end of the sheet P, and the sheet P is thereby inverted and conveyed to the re-supplying path 36. When the sheet P is introduced into the re-supplying path 36, as shown in FIG. 5B, the pivot 54*a* of the sheet feeding roller 54 is rotated by an unillustrated control unit. Due to the rotation of the pivot 54*a*, the first cams 60, the second cams 64, and the third cams 66 rotate integrally therewith. Then, rotation of the pivot 54*a* is stopped at the position where the first cams 60 abut the rollers 52*a* of the sheet feed tray 52, the second cams 64 abut the frame 62, and the third cams 66 abut the guiding member 58.

At this time, as shown in FIGS. 5A and 5B, since the first cams 60 push the sheet feed tray 52 downward against the urging force of the spring 72, the sheets P stacked in the sheet feed tray 52 do not contact the sheet feeding roller 54. Further, due to the second cams 64 pushing the frame 62 downward against the urging force of the spring 74, the separating roller 56 is withdrawn from the position of press-contacting the sheet feeding roller 54. Moreover, due to the third cams 66 pushing the guiding member 58 downward against the urging force of the spring 76, the guiding member 58 rotates from the withdrawn position B (see FIGS. 4A and 4B) to the guiding position A, and a gap through which the sheet P can pass is formed between the guiding member 58 and the sheet feeding roller 54.

As shown in FIG. 5A, the sheet P, which is sent-in from the re-supplying path 36, is guided by the guide plates 80, 82 to the portion where the sheet feeding roller 54 and the guiding member 58 oppose one another, and is conveyed in the direction of arrow D along the guiding member 58 between the sheet feeding roller 54 and the guiding member 58. At this time, since the separating roller 56 is withdrawn from the position of press-contacting the sheet feeding roller 54, the sheet P passes smoothly beneath the sheet feeding roller 54, and is guided by the guide plates 84, 86 to the conveying rollers 28. Then, the sheet P is again conveyed to the image forming section 12. At the image forming section 12, an image is formed on the reverse surface of the sheet P.

On the other hand, as shown in FIG. 4B, when the sheet P is to be fed from the sheet feed tray 52, the sheet feeding roller 54 is rotated by the rotation of the pivot 54*a*. As the pivot 54*a* rotates, the abutment of the first cams 60 and the rollers 52*a*, and the abutment of the second cams 64 and the frame 62, and the abutment of the third cams 66 and the guiding member 58 are cancelled (refer to the state of abutment of FIG. 5B). Due to the abutment of the first cams 60 and the rollers 52*a* being cancelled, the sheet feed tray 52 moves upward due to the urging force of the spring 72, and the top surface of the sheets P stacked in the sheet feed tray 52 is pushed against the sheet feeding roller 54. Due to the abutment of the second cams 64 and the frame 62 being cancelled, the frame 62 is pushed upward by the urging force of the spring 74, and the separating roller 56 press-contacts the sheet feeding roller 54. Due to the abutment of the third cams 66 and the guiding member 58 being cancelled, the guiding member 58, due to the urging force of the spring 76, rotates to the withdrawn position B which is toward the sheet feeding roller 54 and at which the guiding member 58 does not project out toward the sheets P.

In this state, due to the rotation of the sheet feeding roller 54, the uppermost sheet P stacked in the sheet feed tray 52 frictionally contacts the sheet feeding roller 54, and this uppermost sheet P is fed-out. At this time, since the guiding member 58 is moved to the withdrawn position B, the sheet P does not collide with the guiding member 58. The sheet P which is fed-out is separated at the time of passing through the nip portion between the sheet feeding roller 54 and the separating roller 56, and the sheets P from the second sheet on are prevented from passing through the nip portion. The sheet P which is fed-out by the sheet supplying device 50 is conveyed to the image forming section 12 by the conveying rollers 28 disposed at the conveying path 27, as shown in FIG. 1.

Thereafter, when the sheet feeding roller 54 rotates, as shown in FIG. 5B, the first cams 60 abut the rollers 52*a* and push the sheet feed tray 52 downward, and the second cams 64 abut the frame 62 and cause the separating roller 56 to withdraw from the sheet feeding roller 54, and the third cams 66 abut the guiding member 58 and move the guiding member 58 to the guiding position A. Namely, as the sheet feeding roller 54 rotates, the movement of the sheet feed tray 52 in the vertical direction, and the press-contacting and withdrawing (releasing of press-contact) of the separating roller 56 with respect to the sheet feeding roller 54, and the rotation of the guiding member 58 between the withdrawn position B and the guiding position A, are carried out interlockingly. Therefore, there is no need for motors used exclusively for rotating the first cams 60 and the second cams 64 and the third cams 66, and costs can be decreased.

In this way, each time the sheet feeding roller 54 rotates one time, the sheet feed tray 52 is raised and lowered, and the press-contacting and withdrawing of the separating roller 56 with respect to the sheet feeding roller 54 is repeated. The sheet P stacked in the sheet feed tray 52 is thereby sent-out one-by-one. At this time, each time the sheet feeding roller 54 rotates one time, the guiding member 58 rotates between the withdrawn position B and the guiding position A. Therefore, after the sheet feed tray 52 rises and the sheet P is sent-out by the sheet feeding roller 54 as shown in FIGS. 4A and 4B, the guiding member 58 moves to the guiding position A as shown in FIGS. 5A and 5B, and the top surfaces of the sheets P from the second sheet on which are stacked in the sheet feed tray 52 are thereby pressed. In this way, the sheets P from the second sheet on which are stacked in the sheet feed tray 52 are kept from pushing through between the sheet feeding roller 54 and the separating roller 56 together with the uppermost sheet P. Therefore, multiple feeding of the sheets P can be prevented, and stable supplying of the sheet P is possible. Further, it is possible to prevent a collision with the sheet P which is being conveyed again and a paper jam from occurring.

In the sheet supplying device 50, since the guiding member 58 rotates between the guiding position A and the withdrawn position B around the pivot 58*b* which is at the sheet feeding direction upstream side, the space over which the guiding member 58 moves can be made to be small, and the image forming device 10 can be made to be compact. Moreover, the feeding of the sheet P from the sheet feed tray 52 and the re-conveying of the sheet P from the re-supplying path 36 can be carried out in a small space while preventing paper jams.

As the sheet feeding roller 54 rotates, the guiding member 58 and the sheet feed tray 52 move substantially simultaneously. Therefore, when the sheet feed tray 52 rises and the sheet P is sent-out, the guiding member 58 moves to the withdrawn position B, and the sheet P does not collide with the guiding member 58. Further, at the time of double-sided printing, simultaneously with the lowering of the sheet feed tray 52, the guiding member 58 moves to the guiding position A, and the sheet P is smoothly supplied from the re-supplying path 26 to the conveying path 27. Therefore, the occurrence of paper jams is prevented.

Since the movement of the guiding member 58 to the withdrawn position B and the movement of the separating roller 56 to the press-contact position are carried out substantially simultaneously, the sheet P, which is being fed-out without interfering with the guiding member 58, is separated at the nip portion between the sheet feeding roller 54 and the separating roller 56, and the sheets P can be separated one-by-one. Thus, the feeding-out and the separating of the sheet P are carried out smoothly. Further, at the time of double-sided printing, the movement of the guiding member 58 to the guiding position A and the withdrawing of the separating roller 56 from the sheet feeding roller 54 are carried out substantially simultaneously. Thus, the sheet P is smoothly supplied from the re-supplying path 36 to the conveying path 27, and the occurrence of paper jams is prevented.

After the uppermost sheet P is sent-out by the sheet feeding roller 54, the guiding member 58 moves to the guiding position A, and the sheets P from the second sheet on are pressed. Therefore, multiple feeding of the sheets P is prevented, and stable supplying of the sheet P is possible. At this time, since the movement of the guiding member 58 to the guiding position A and the withdrawing of the separating roller 56 from the sheet feeding roller 54 are carried out substantially simultaneously, the feeding-out and the separating of the sheet P are carried out smoothly.

In the above-described sheet supplying device 50, a structure may be used in which the mounting positions and the configurations of the first cams 60 and the third cams 66 are adjusted such that the guiding member 58 moves after the sheet feed tray 52 moves. In this structure, even if the maximum amount of the sheets P is stacked in the sheet feed tray 52, since the sheet feed tray 52 is lowered first, the movement of the guiding member 58 to the guiding position A is not impeded by the sheets P. Further, a structure may be employed in which, by adjusting the mounting positions and the configurations of the second cams 64 and the third cams 66, the guiding member 58 moves after the separating roller 56 moves. In this structure, since the guiding member 58 moves to the guiding position A after the separating roller 56 is withdrawn, movement of the guiding member 58 is not impeded by the sheet P which is nipped by the sheet feeding roller 54 and the separating roller 56.

In the above-described sheet supplying device 50, it is preferable that a structured is employed such that the timings of the movements at the time of sheet feeding are as follows: the separating roller 56 abuts the sheet feeding roller 54, the sheet feed tray 52 begins to rise, and the guiding member 58 rotates to the withdrawn position B. This is in order to avoid entry of the sheet P between the separating roller 56 and the sheet feeding roller 54 if the region therebetween opens up, and in order to withdraw the guiding member 58 after the guiding member 58 presses the sheets P stacked in the sheet feed tray 52. In this way, multiple feeding of the sheets P can be reduced even more. Further, it is preferable that a structured is employed such that the timings of the movements after sheet feeding are as follows: the sheet feed tray 52 in which the sheets P are stacked begins to fall (the sheets P move away from the sheet feeding roller 54), the separating roller 56 withdraws from the sheet feeding roller 54, and the guiding member 58 rotates to the guiding position A. This is because, if the guiding member 58 is lowered before the separating roller 56, there is the concern that the sheets P will bend and a paper jam will arise.

Further, although the sheet feed tray 52 is disposed in the image forming device 10 shown in FIG. 1, instead, a manual sheet feed tray which can be opened and closed may be provided at the front of the lower portion of the image forming device. Moreover, the sheet feeding roller 54 is structured as a manual-feed sheet feeding roller which is disposed in the direction of sending-out the sheets P which are in the manual sheet feed tray, and the guiding member 58 is structured so as to rotate between the guiding position A of guiding the sheet P from the re-supplying path 36 at the time of double-sided printing, and the withdrawn position B toward the manual-feed sheet feeding roller so that the sheet P can be sent-out. By making the sheet feed tray 52 be a manual sheet feed tray which can open and close, the sheet feeding section at the front of the image forming device takes up less space, and the device can be made to be even more compact.

Next, a second embodiment of the sheet supplying device relating to the present invention will be described on the basis of the drawings.

Members which are the same as those of the first embodiment are denoted by the same reference numerals, and repeat description thereof will be omitted.

Figure 6A:
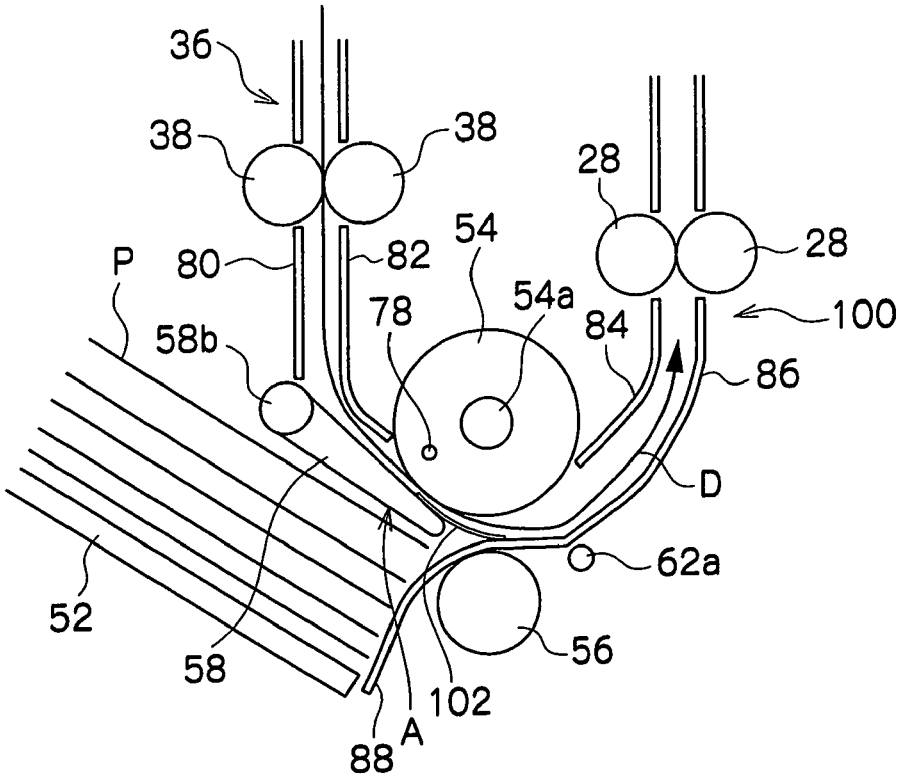
FIGS. 6A and 6B are schematic structural diagrams showing a sheet supplying device relating to a second embodiment of the present invention.
Figure 6B:
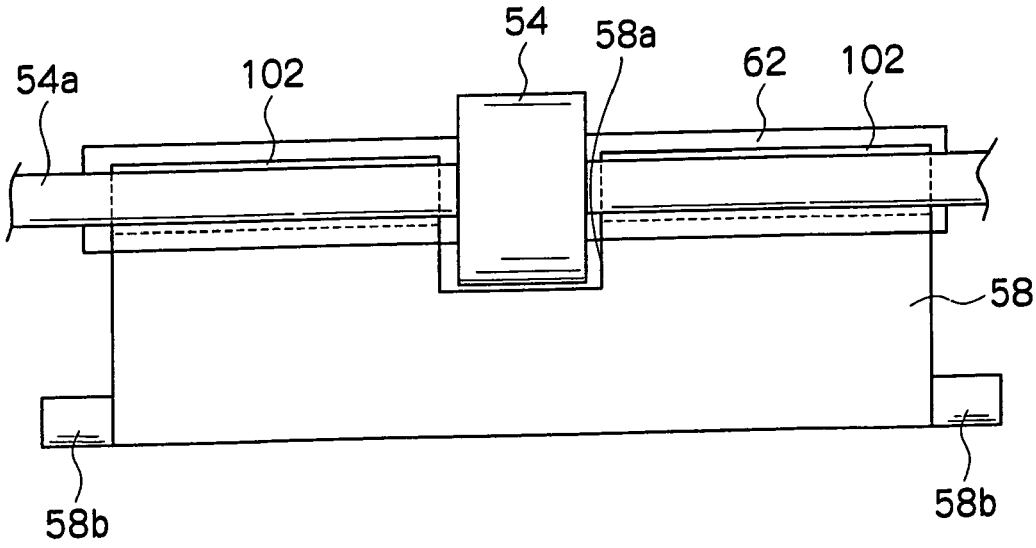

As shown in FIGS. 6A and 6B, in a sheet supplying device 100, film sheets 102 are provided at the distal end portion of the guiding member 58 at the both sides of the cut-out portion 58*a*. The length of the film sheet 102 is set to a length such that the distal end of the film sheet 102 abuts the guide plate 88 when the guiding member 58 moves to the guiding position A. The film sheets 102 are sheets formed of a synthetic resin such as polyimide or the like, and are affixed to the distal end portion of the guiding member 58 by an adhesive.

In the sheet supplying device 100, when the guiding member 58 rotates to the guiding position A, the separating roller 56 withdraws from the sheet feeding roller 54, and the distal ends of the film sheets 102 abut the guide plate 88. Owing to these film sheets 102, the connection between the guiding member 58 and the guide plate 88 is smooth, and the sheet P, which is sent-in along the re-supplying path 36 at the time of double-sided printing, is smoothly conveyed to the conveying rollers 28 of the conveying path 27. Further, since the film sheets 102 are provided at the distal end portion of the guiding member 58 at the both sides of the cut-out portion 58*a*, the film sheets 102 do not interfere with the sheet feeding roller 54 at the time when the guiding member 58 rotates to the withdrawn position B (see FIGS. 4A and 4B).

Next, a third embodiment of the sheet supplying device relating to the present invention will be described on the basis of the drawings.

Members which are the same as those of the first embodiment are denoted by the same reference numerals, and repeat description thereof will be omitted.

Figure 7A:
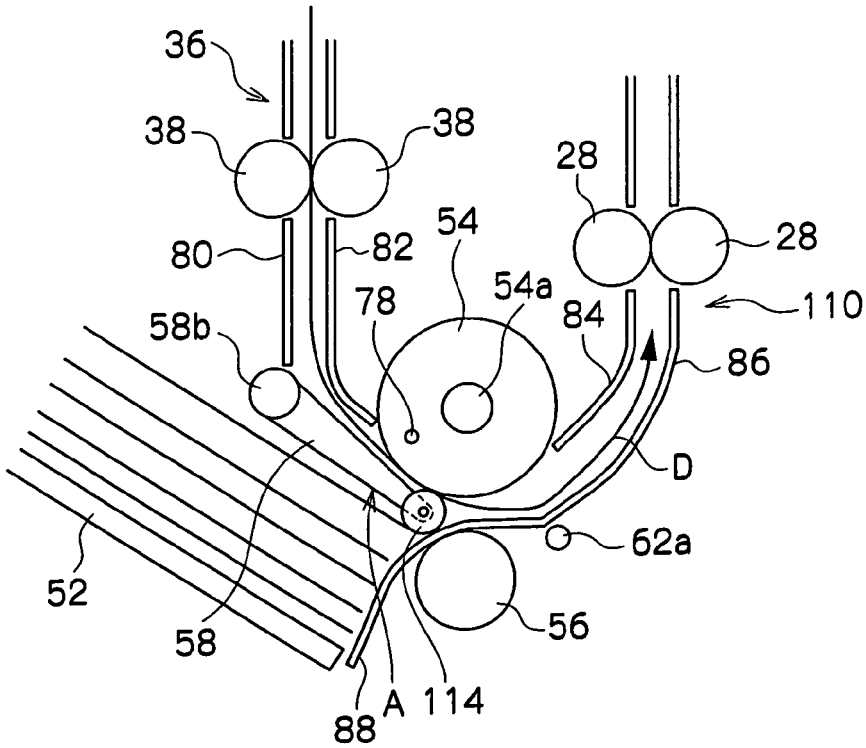
FIGS. 7A and 7B are schematic structural diagrams showing a sheet supplying device relating to a third embodiment of the present invention.
Figure 7B:
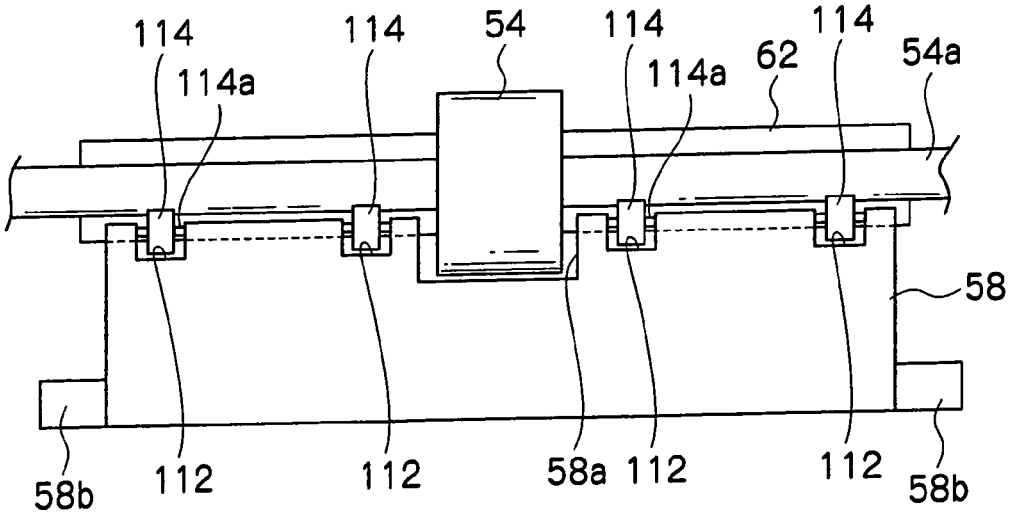

As shown in FIGS. 7A and 7B, in a sheet supplying device 110, two concave portions 112 are formed in the distal end portion of the guiding member 58 at either side of the cut-out portion 58*a*. Rollers 114 are rotatably supported by shaft portions 114*a* in these four concave portions 112 of the guiding member 58. When the guiding member 58 moves to the guiding position A, the rollers 114 abut the guide plate 88.

In the sheet supplying device 110, when the guiding member 58 rotates to the guiding position A, the separating roller 56 withdraws from the sheet feeding roller 54, and the peripheral surfaces of the rollers 114 abut the guide plate 88. At the time of double-sided printing, the sheet P which is sent-in along the re-supplying path 36 passes between the rollers 114 and the sheet feeding roller 54. Therefore, the friction between the sheet P and the guiding member 58 is decreased, and the sheet P is smoothly conveyed due to the rotation of the rollers 114. Then, the sheet P is guided by the guide plate 88 and conveyed to the conveying rollers 28 of the conveying path 27. Moreover, since the rollers 114 are provided at the distal end portion of the guiding member 58 at the both sides of the cut-out portion 58*a*, the rollers 114 do not interfere with the sheet feeding roller 54 when the guiding member 58 rotates to the withdrawn position B (see FIGS. 4A and 4B).

In the above-described embodiments, the sheet P which is fed from the sheet feed tray 52 is separated at the nip portion between the sheet feeding roller 54 and the separating roller 56. However, the present invention is not limited to this structure. For example, a structure may be used in which the sheet P is separated by the sheet feeding roller and a pad being pressed into contact with one another.

What is claimed is:

1. A sheet supplying device supplying a sheet to an image forming section, the device comprising:

a sheet feeding roller sending sheets out one-by-one;

a sheet stacking section in which a plurality of sheets can be stacked, and which pushes a sheet against the sheet feeding roller; and a guiding member, controlled by a control unit, to move between a guiding position at which, at a time of double-sided printing, the guiding member is moved away from the sheet feeding roller and re-supplies to the image forming section an inverted sheet which is sent-in by a sheet re-supplying section, and a withdrawn position, at which the guiding member is moved toward the sheet feeding roller and at which feeding of the sheet of the sheet stacking section is possible.

2. The sheet supplying device of claim 1, wherein the guiding member is provided so as to be able to rotate between the guiding position and the withdrawn position, with a pivot being at an upstream side in a sheet feeding direction.

3. The sheet supplying device of claim 1, wherein an opening portion, which eliminates interference with the sheet feeding roller when the guiding member moves to the withdrawn position, is formed in the guiding member.

4. The sheet supplying device of claim 1, wherein movement of the guiding member is controlled by a cam that rotates interlocked with the sheet feeding roller.

5. The sheet supplying device of claim 4, wherein in response to the rotating, the cam contacts the guiding member causing the movement of the guiding member.

6. The sheet supplying device of claim 1, wherein a film sheet, which abuts a guide plate that guides a sheet to the image forming section, is provided at a distal end of the guiding member.

7. The sheet supplying device of claim 1, wherein a roller, which abuts a guide plate that guides a sheet to the image forming section, is provided at a distal end of the guiding member.

8. The sheet supplying device of claim 1, wherein, each time a sheet is fed from the sheet stacking section, the guiding member moves to the guiding position, and, at the guiding position, presses the sheets which are stacked in the sheet stacking section.

9. The sheet supplying device of claim 1, further comprising:

a separating member which press-contacts a sheet between the sheet feeding roller and the separating member, and separates the sheet; and a press-contact canceling portion which withdraws the separating member from the sheet feeding roller.

10. The sheet supplying device of claim 9, wherein movement of the guiding member and movement of the separating member by the press-contact canceling portion are interlocked.

11. The sheet supplying device of claim 10, wherein the guiding member and the separating member move simultaneously.

12. The sheet supplying device of claim 10, wherein the guiding member moves after the separating member moves.

13. The sheet supplying device of claim 1, wherein movement of the guiding member and movement of the sheet stacking section are interlocked.

14. The sheet supplying device of claim 13, wherein the guiding member and the sheet stacking section move simultaneously.

15. The sheet supplying device of claim 13, wherein the guiding member moves after the sheet stacking section moves.

16. The sheet supplying device of claim 1, wherein rotation of the sheet feeding roller and movement of the guiding member are interlocked.

17. An image forming device comprising:

an image forming section forming an image on a sheet;

a sheet re-supplying section for re-supplying, to the image forming section, a sheet that is inverted after passing through the image forming section; and a sheet supplying device supplying a sheet to the image forming section, wherein the sheet supplying device has:

a sheet feeding roller sending sheets out one-by-one;

a sheet stacking section in which a plurality of sheets can be stacked and which pushes a sheet against the sheet feeding roller; and a guiding member, controlled by a control unit, to move between a guiding position at which, at a time of double-sided printing, the guiding member re-supplies to the image forming section the inverted sheet that is sent-in by the sheet resupplying section, and a withdrawn position, at which the guiding member is moved toward the sheet feeding roller and at which feeding of the sheet of the sheet stacking section is possible.

18. The image forming device of claim 17, wherein the sheet stacking section provided at the sheet supplying device is a manual sheet feed tray disposed at a front of an image forming device main body, and a sheet within the manual sheet feed tray is supplied to the image forming section.

19. The image forming device of claim 17, wherein movement of the guiding member is controlled by a cam that rotates interlocked with the sheet feeding roller.

20. The image forming device of claim 19, wherein in response to the rotating, the cam contacts the guiding member causing the movement of the guiding member.

* * * * *